US007275977B1

(12) United States Patent
Rhodes

(10) Patent No.: US 7,275,977 B1
(45) Date of Patent: Oct. 2, 2007

(54) THERAPEUTIC BRA

(76) Inventor: Rhonda Rhodes, 1943 E. Fortuna Ct., Kingman, AZ (US) 86409

( * ) Notice: Subject to any disclaimer, the term of this patent is extended or adjusted under 35 U.S.C. 154(b) by 0 days.

(21) Appl. No.: 11/405,497

(22) Filed: Apr. 18, 2006

(51) Int. Cl.
*A41C 3/10* (2006.01)
*A41C 3/00* (2006.01)

(52) U.S. Cl. ..... 450/54; 450/38

(58) Field of Classification Search ..... 450/38, 450/36, 37, 54–58; 607/96, 108, 112, 114; 2/69, 102, 249, 250, 251
See application file for complete search history.

(56) References Cited

U.S. PATENT DOCUMENTS 1,391,936 A * 9/1921 Bosky ..... 450/1
2,298,361 A 10/1942 Freund et al.
2,492,862 A * 12/1949 Harvey ..... 450/89
2,503,847 A * 4/1950 Shanahan ..... 450/89
2,593,711 A * 4/1952 Weatherly ..... 450/89
3,078,852 A * 2/1963 Stapleton ..... 450/89
3,326,218 A 6/1967 McAlpine
3,516,414 A 6/1970 Greenough
3,995,621 A 12/1976 Fletcher et al.
5,050,595 A 9/1991 Krafft
5,133,348 A 7/1992 Mayn
5,427,563 A 6/1995 Manning
5,679,052 A 10/1997 Rucki
5,826,273 A * 10/1998 Eckes ..... 2/69
6,241,715 B1 6/2001 Houser et al.
6,390,885 B1 * 5/2002 Brooks ..... 450/1
6,394,879 B1 * 5/2002 Paige ..... 450/38
6,398,620 B1 6/2002 Huang
6,419,548 B1 7/2002 Wittes et al.
6,464,717 B1 * 10/2002 Smith et al. ..... 607/108
6,695,678 B1 2/2004 Foley et al.

* cited by examiner

*Primary Examiner*—Gloria M. Hale
(74) *Attorney, Agent, or Firm*—Christopher Wood; Wood & Eisenberg, PLLC

(57) ABSTRACT

A therapeutic bra (100) for reducing breast tissue inflammation in a woman who has recently undergone breast surgery. The therapeutic bra (100) is made up of a sports bra (110), which comprises a front breast section (120), opposite bra sides (140, 160), first (180) and second (200) shoulder straps, and a rear section (220) located between the first (140) and second (160) opposite bra sides. The front breast section (120) comprises an outer layer (260) made up of hook and loop fastener material (125) such as hooks, loops, alone or in combination, and a therapeutic pouch (115). The therapeutic pouch (115) comprises front (280) and rear (300) sides, an opening (320), and an interior (330) accessible via opening (320). The rear side (300) is at least partly covered with complementary hooks, loops, alone or in combination (310) to reversibly attach to the outer layer (260).

12 Claims, 5 Drawing Sheets

Fig. 4
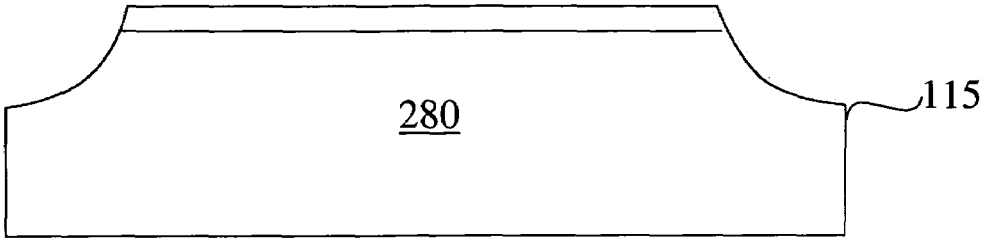
Fig. 5
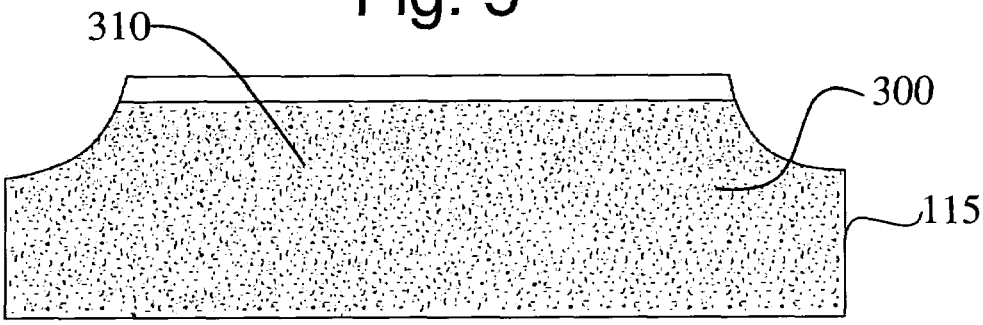
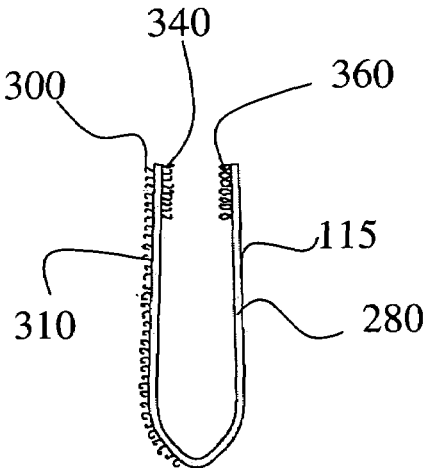
Fig. 6
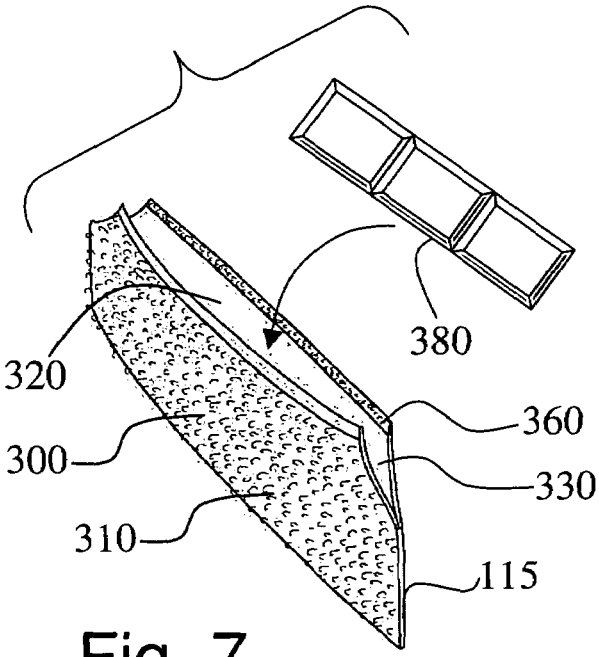
Fig. 7

THERAPEUTIC BRA

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

This invention relates generally to therapeutic bras. More specifically, this invention relates to a bra designed to cool a woman's breast area to reduce inflammation following breast surgery.

BACKGROUND OF THE INVENTION

Women with operable breast cancer or other breast issues requiring surgery and who undergo breast surgery frequently suffer post-op inflammation. The prior art discloses various attempts at providing cooling to various areas of a human body. For example, U.S. Pat. No. 6,464,717, issued Oct. 15, 2002 to Smith et al., describes a bra with hot-cold inserts is a therapeutic device in the form of a vest-like elastic garment adapted to be worn on the human upper torso. The device includes front panels having pockets therein for retaining gel packs. The device is said to be effective in providing warm or cold therapy to the chest and rib areas.

U.S. Pat. No. 2,298,361, issued Oct. 13, 1942 to Freund, describes an ice or hot water breast bag.

U.S. Pat. No. 3,326,218, issued Jun. 20, 1967 to McAlpine, describes a post-pregnancy bra for reducing swelling and pain in a female body. The '218 patent refers to sets of interchangeable breast cups adapted to hold a cooling agent. The breast cups can be placed in turn inside a fridge and then in the '218 bra to provide a cooling effect.

U.S. Pat. No. 3,995,621, issued Dec. 7, 1976 to Fletcher et al., describes a device for enhancing the detection of malignant tissue in the breasts of a woman comprises a brassiere-like garment which is fitted with a pair of liquid-perfused cooling panels which completely and compliantly cover the breasts and upper torso. The garment is connected by plastic tubing to a liquid cooling system comprising a fluid pump, a solenoid control valve for controlling the flow of fluid to either the cooling unit or the heating unit, a fluid reservoir, a temperature sensor in the reservoir, and a restrictor valve to control the pressure in the garment inlet cooling line.

U.S. Pat. No. 5,050,595, issued Sep. 24, 1991 to Krafft, describes a women's therapeutic support garment comprising a pair of breast supporting cups each of which is formed with an inner and an outer panel defining therebetween one of two cupped shaped pockets. A cupped shaped, thermal gel pack is placed in each pocket and has a central opening for accommodating the women's nipple. A pair of side panels are connected to the breast supporting cups, the side panels being dimensioned and configured to encircle the wearer and hold the breast supporting cups in place with the gel packs surrounding the women's breasts. The heat from each gel pack serves to reduce swelling and tenderness of the breast tissues during the premenstrual period, pregnancy or the post-partum period.

U.S. Pat. No. 5,133,348, issued Jul. 28, 1992 to Mayn, describes a contoured pack with a hot or cold pack having a main body portion and four radially extending portions attached thereto and integral therewith. The radially extending portions may have a width greater at their periphery than at the joining to the main body portion. The hot or cold pack is particularly useful for application to a curved contour such as breast, knee, ankle, shoulder or other body area to relieve post operative or post trauma pain and inflammation.

U.S. Pat. No. 5,427,563, issued Jun. 27, 1995 to Manning, describes a breast wrap with two rectangular non-stretching panels of cotton flannel material joined over a user's back by short elastic strips, and joined in overlapping relationship across the breasts by upper and lower complementary hook-and-loop fasteners running marginally along upper and lower longitudinal edges. The panels run lengthwise in opposite directions from the user's back, under one arm, across both breasts, and terminate at a point located under the other arm; the panels run widthwise from above the breasts to below the breasts; and the fasteners are located so they will not be pressed into the breasts. Two rectangular open-ended pouches having pockets for crushed ice, are held between the overlapping panels by additional hook-and-loop fasteners that mate with fasteners.

U.S. Pat. No. 5,679,052, issued Oct. 21, 1997 to Rucki, describes a breast pack for providing warm or cold therapy to the female breast is disclosed. The breast pack can be formed of a generally C-shaped or semicircular top layer and bottom layer, each having a central opening, which layers are joined along their perimeter edges to define a pocket therebetween which is filled with a thermal gel material. The breast pack, when heated or cooled, retains such heat or coolness for a long period of time. In use, the breast pack is formed into a conical shape by overlapping its ends and adjusted to the size and contour of the user's breast. The breast pack can be retained in position within the user's bra. A central opening in the C-shaped breast pack accommodates the nipple area of the user's breast.

U.S. Pat. No. 6,241,715, issued Jun. 5, 2001 to Houser et al., describes a disposable therapeutic breast pad for heating or cooling the female breast during nursing comprising a generally disc-shaped, moisture-impervious outer layer and an absorbent material disposed inwardly of the outer layer adapted to be soaked in hot or cold water so that the breast pad may be positioned adjacent the female breast with the absorbent material in direct contact therewith to heat or cool the female breast during nursing.

The Applicant is unaware of inventions or patents, taken either singly or in combination, which are seen to describe the instant invention as claimed.

SUMMARY OF THE INVENTION

A therapeutic bra (100) for reducing breast tissue inflammation in a woman who has recently undergone breast surgery. The therapeutic bra (100) is made up of a sports bra (110), which comprises a front breast section (120), opposite bra sides (140) and (160), first (180) and second (200) shoulder straps, and a rear section (220) located between the first (140) and second (160) opposite bra sides. The front breast section (120) comprises an outer layer (260) made up of material (125) such as hooks, loops, alone or in combination, and a therapeutic pouch (115). The therapeutic pouch (115) comprises opposite front (280) and rear (300) sides, an opening (320), and an interior (330) accessible via the opening (320). The rear side (300) is at least partly covered with complementary hooks, loops, alone or in combination to reversibly attach to the outer layer (260).

BRIEF DESCRIPTION OF THE DRAWINGS

FIG. 4 shows a front view of pouch (115).

FIG. 5 shows a rear view of the pouch (115) of FIG. 4.

FIG. 6 shows a cross-section view about halfway along the pouch (115) of FIG. 4.

FIG. 7 shows an elevated perspective view of the pouch (115) of FIG. 4.

Similar reference characters denote corresponding features consistently throughout the attached drawings.

DETAILED DESCRIPTION OF THE PREFERRED EMBODIMENTS

Figure 1:
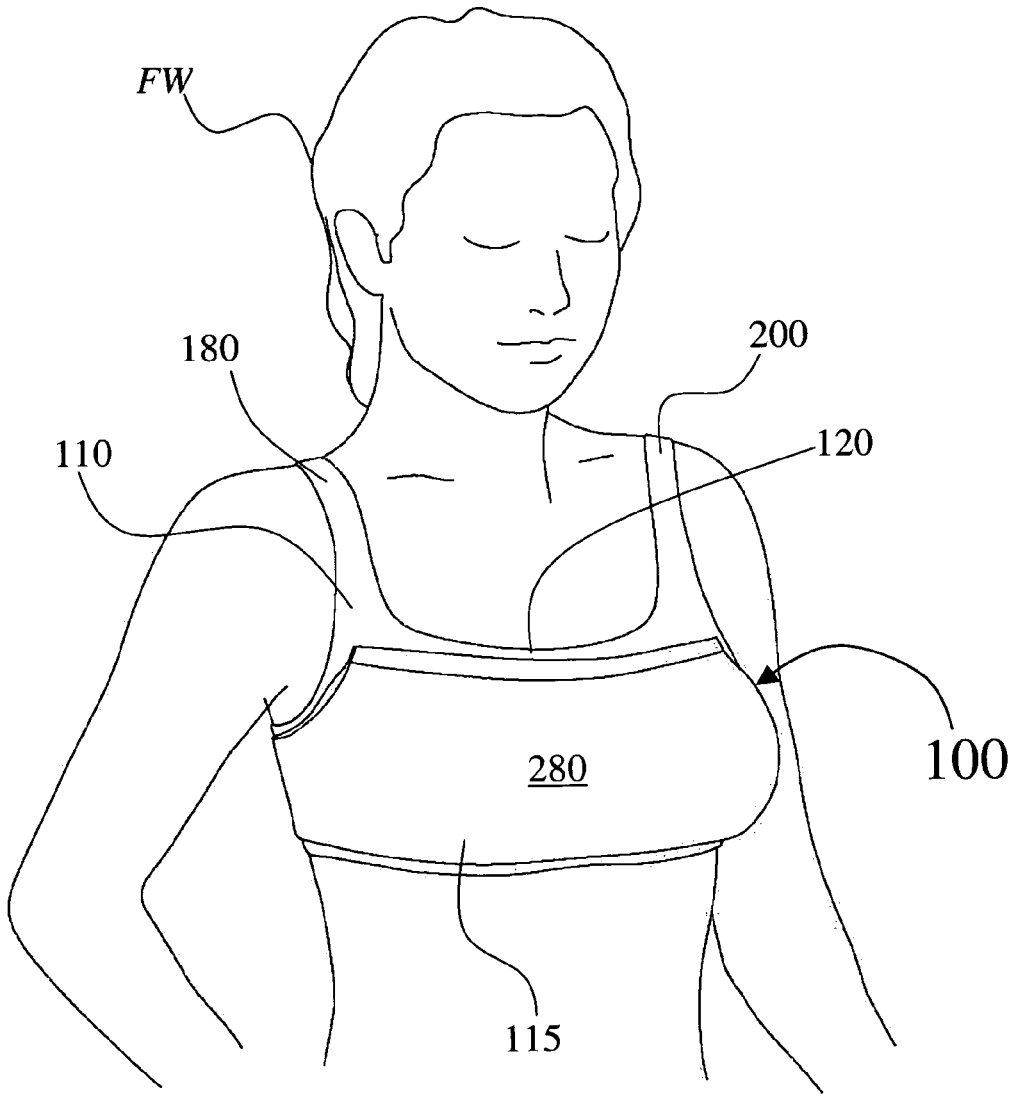
FIG. 1 is an environmental perspective view of a therapeutic bra (100), according to the invention.

This invention is directed to therapeutic bras. More specifically, this invention relates to a bra designed to cool a woman's breast area to reduce inflammation following breast surgery. The therapeutic bra of the invention is generally denoted by the numeric label "100".

Referring to FIGS. 1 through 7, which disclose a first embodiment of the present invention. The therapeutic bra 100 comprises a sports bra 110 adapted to carry a therapeutic pouch 115. The therapeutic pouch 115 is used to carry cold or hot medium for applying cold or heat to a woman's breast area. The sports bra 110 has a front breast section 120, opposite bra sides 140 and 160, first 180 and second 200 shoulder straps, and a rear section 220 located between the first 140 and second 160 opposite sides.

Figure 2:
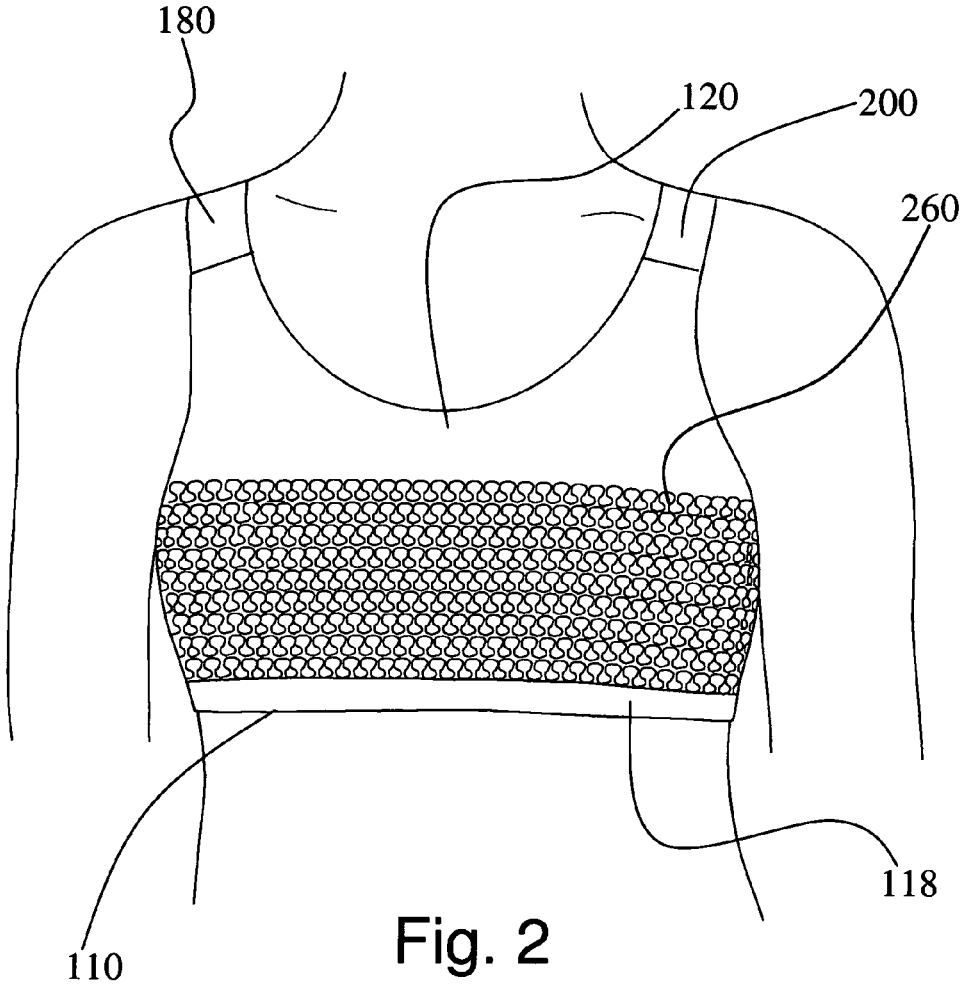
FIG. 2 is a front view of the therapeutic bra of FIG. 1, excluding a therapeutic pouch (115).
Figure 3:
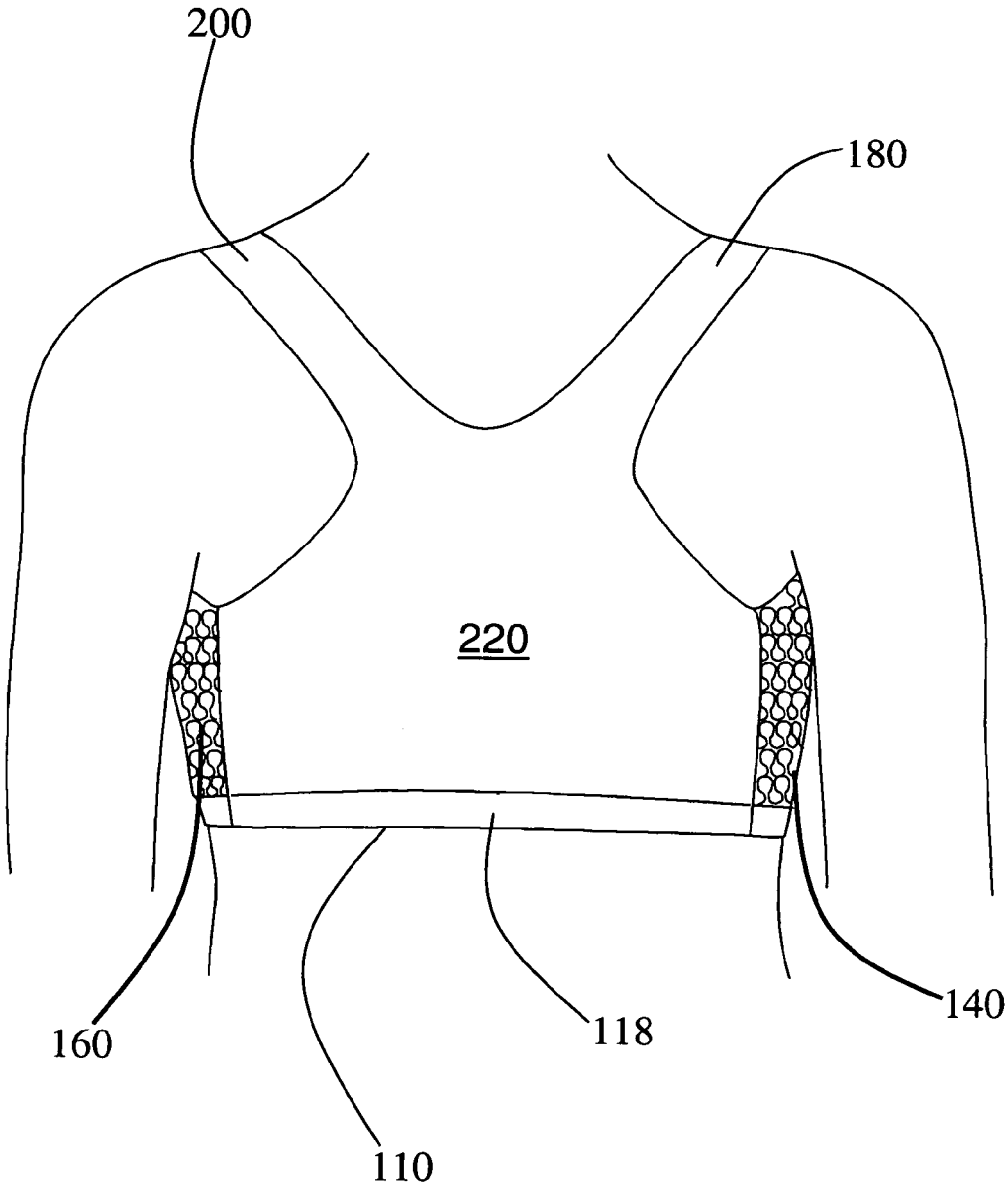
FIG. 3 is rear view of the therapeutic bra (100) of FIG. 1 excluding a therapeutic pouch (115).
Figure 3A:
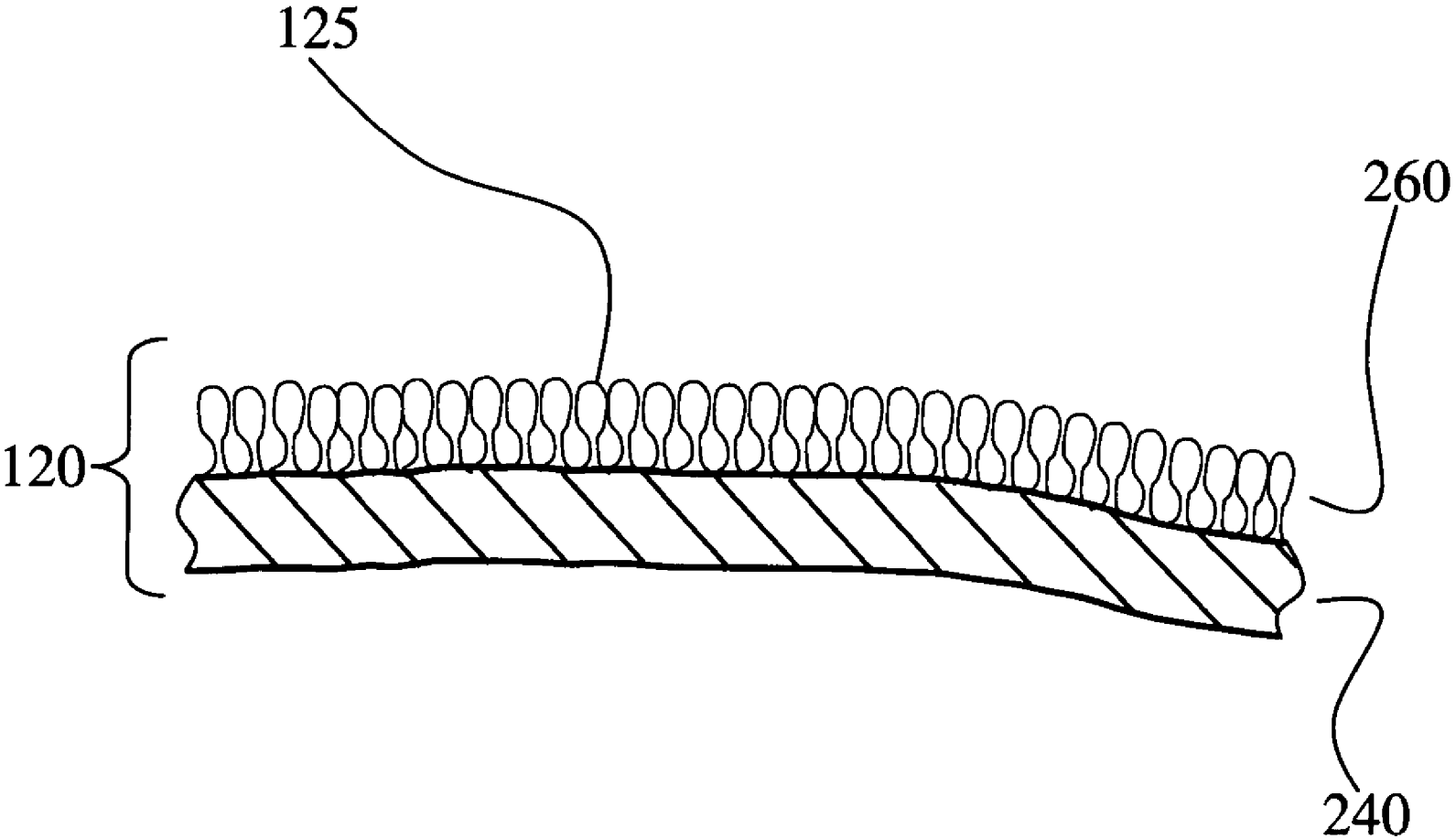
FIG. 3A shows a cross-section view of the front section (120) of the therapeutic bra of FIG. 2.

The front section 120 of the sports bra 110 comprises an inner layer 240 of conventional bra material and an outer layer 260 made up of VELCRO® hook and loop fastener material 125, such as VELCRO hooks, loops, alone or in combination (see FIG. 3A); VELCRO is a registered trademark of Velcro Industries. The outer layer 260 is a generally elongated area of VELCRO® hook and loop fastener, which covers at least part of the front breast section 120, and optionally covers the exterior of first and second opposite sides 140 and 160, respectively (see FIG. 2). The inner layer 240 can be made of any suitable material such as, but not limited to, stretchable cotton.

An optional continuous elastic band 118 forms part of the bottom of the bra 110 (see FIGS. 2 and 3). The front breast section 120 is sized to cover a woman's breasts. It will be understood by a person of ordinary skill in the art that sports bras are supplied in a variety of sizes to suit a range of women with different breast dimensions.

The therapeutic pouch 115 (see FIGS. 1, and 4 through 7) is designed to reversibly attach to the outer layer 260. The pouch 115 comprises opposite front 280 and rear 300 sides. The rear side 300 is at least partly covered with complementary VELCRO® hook and loop fastener 310. For example, if outer layer 260 comprises VELCRO® loops, then the rear side 300 will comprise complementary VELCRO® hooks, and vice versa. The pouch 115 further comprises an opening 320, which opens into the pouch interior 330. The opening 320 is reversibly sealable by means of opposite facing complementary VELCRO® hook and loop fastener strips 340 and 360. It will be understood by a person of ordinary skill in the art that any suitable means, such as a zipper, male and female connectors, clips, and any other type of suitable fastener can reversibly seal the opening 320 of pouch 115. Alternatively, the pouch 115 can be made sufficiently elastic and taut to ensure that the opening 320 has to be pulled open to allow the female wearer FW to insert a thermal aid 380. The thermal aid 380 can be a fresh cold pack, a hot pack, or a fresh dual hot-cold pack. A cold pack could be, for example, ice (such as crushed ice) secured inside a zip-lock bag. Non-limiting specific examples of a cold pack include the Colpac narrow size (3 inches by 11 inches) made by Chattanooga, and the Chattanooga Black Urethane Half Size Colpac Ice Pack (6.5 inches by 11 inches). A hot pack could be, for example, heatable beads secured inside a cotton bag.

A dual hot-cold pack could be, for example, a reusable hot and cold Flexi-Pac™, which can be microwaved to provide soothing heat, or after freezer storage, provide penetrating cold therapy. The Flexi-Pac™ is supplied, for example, by Sportstek Physical Therapy Supplies Pty Ltd, 6 Park Road, Oakleigh, Victoria 3166, Australia. It should be understood that the term "dual hot-cold pack" refers to packs, which may or may not be reusable, that can be either heated or cooled prior to use. Another suitable dual hot-cold pack is the hot-cold small sectional sack (4 inches in width, 7 inches high, 11 inches in length), which can be purchased from Target Stores nationwide (e.g., Target at 5115 Leesburg Pike, Falls Church, Va. 22041-3207 US), or ordered online from Target Stores (part of Target Corp., 1000 Nicollet Mall, Minneapolis, Minn. 55403, Phone: 612-304-6073, Fax: 612-370-5502).

Other examples of the dual hot-cold pack include gel packs that can be cooled, for example, in a freezer (such as a kitchen freezer) or heated, for example, in a conventional domestic microwave machine (or its functional equivalent) or by immersion in hot water. Yet another example of a suitable dual hot-cold pack is the Jack Frost™ hot and cold pack, which is a flexible pack that freezes as a cold pack or can be heated in a microwave or hot water (dimensions: 0.4.5 inches by 10 inches by 0.5 inches, but the pouch 115 can be designed to hold various suitable sizes of hot and cold packs). The Jack Frost™ hot and cold pack is supplied, for example, by SHOP.COM (item #: 1001682); SHOP.COM is a privately held company headquartered in Monterey, Calif., USA.

The pouch 115 is reversibly attached to the sports bra 110 by pressing outer layer 260 and rear side 300 together thereby providing therapeutic bra 100. The outer layer 260 and rear side 300 comprise complementary VELCRO® hook and loop fastener. For example, outer layer 260 can comprise of hooks and rear side 300 can comprises complementary loops, and vice versa. The dimensions of the pouch 115 can be made to fit, for example, a range of cold or hot packs, or a specifically sized cold or hot pack.

It is envisioned that patients who have recently undergone breast replacement or breast augmentation surgery will use the therapeutic bra 100 to control post-op inflammation of their breast area. However, any woman might find use for the therapeutic bra 100, including women who have not undergone recent breast surgery.

In one aspect of the present invention, a therapeutic bra (100) is provided for reducing breast tissue inflammation in a woman who has recently undergone breast surgery. The therapeutic bra (100) is made up of a sports bra (110), which comprises a front breast section (120), opposite bra sides (140) and (160), first (180) and second (200) shoulder straps, and a rear section (220) located between the first (140) and second (160) opposite bra sides. The front breast section (120) comprises an outer layer (260) made up of VELCRO® hook and loop fastener material (125), and a therapeutic pouch (115). The therapeutic pouch (115) comprises opposite front (280) and rear (300) sides, an opening (320), an interior (330) accessible via the opening (320). The rear side (300) is at least partly covered with complementary VELCRO® hook and loop fastener (310) to reversibly attach to the outer layer (260).

It is to be understood that the present invention is not limited to the embodiments described above, but encompasses any and all embodiments within the scope of the following claims.

I claim:

1. A therapeutic bra (100) for reducing breast tissue inflammation in a woman who has recently undergone breast surgery, comprising:

a sports bra (110), said sports bra (110) comprising:

a front breast section (120) first and second, opposite bra sides (140), (160), first (180) and second (200) shoulder straps, and a rear section (220) located between said first (140) and second (160) opposite bra sides, wherein said front breast section (120) comprises an outer layer (260) made up of a hook and loop fastener material component of hooks or loops; and a therapeutic pouch (115), said therapeutic pouch (115) comprises:

opposite front (280) and rear (300) sides, an opening (320), an interior (330) accessible via said opening (320), wherein said rear side (300) is at least partly covered with complementary hooks or loops of a hook and loop fastener to reversibly attach to said front breast section outer layer (260).

2. The therapeutic bra (100) of claim 1, wherein said outer layer (260) extends to and covers said opposite bra sides (140), (160).

3. The therapeutic bra (100) of claim 1, wherein said opening (320) is reversibly sealable by means of opposite facing complementary hook and loop fastener material fastening strips (340), (360).

4. The therapeutic bra (100) of claim 1, wherein said pouch (115) contains a cold pack.

5. The therapeutic bra (100) of claim 1, wherein said pouch (115) contains a hot pack.

6. The therapeutic bra (100) of claim 1, wherein said pouch (115) contains a dual hot-cold pack.

7. A therapeutic bra (100) for reducing breast tissue inflammation in a woman who has recently undergone breast surgery, comprising:

a sports bra (110), said sports bra (110) comprising:

front breast section (120), opposite bra sides (140) and (160), first (180) and second (200) shoulder straps, and a rear section (220) located between said first (140) and second (160) opposite bra sides, wherein said front breast section (120) comprises an outer layer (260) made up of hooks or loops; and a therapeutic pouch (115), said therapeutic pouch (115) comprises:

opposite front (280) and rear (300) sides, an opening (320), an interior (330) accessible via said opening (320), wherein said rear side (300) is at least partly covered with complementary hooks or loops to reversibly attach to said outer layer (260); and a thermal aid.

8. The therapeutic bra (100) of claim 7, wherein said outer layer (260) extends to and covers said first (140) and second (160) opposite sides.

9. The therapeutic bra (100) of claim 7, wherein said opening (320) is reversibly sealable by means of opposite facing complementary strips (340), (360).

10. The therapeutic bra (100) of claim 7, wherein said thermal aid is a cold pack.

11. The therapeutic bra (100) of claim 7, wherein said thermal aid is a hot pack.

12. The therapeutic bra (100) of claim 7, wherein said thermal aid is a dual hot-cold pack.

* * * * *